United States Patent [19]

Le Cornec

[11] 3,981,110

[45] Sept. 21, 1976

[54] DWELLING HOUSE

[76] Inventor: André Le Cornec, 30 rue de la Mairie, 91220 Bretigny-sur-orge, France

[22] Filed: Mar. 10, 1975

[21] Appl. No.: 557,026

[30] Foreign Application Priority Data

Apr. 18, 1974 France ..... 74.13520

[52] U.S. Cl. ..... 52/169 R; 52/107; 52/742

[51] Int. Cl.[2] ..... E04F 17/06; E02D 27/00

[58] Field of Search ..... 52/169, 198, 107, 742; 237/1 A, 1 R

[56] References Cited

UNITED STATES PATENTS

| | | | |
|---|---|---|---|
| 1,803,091 | 4/1931 | Bemis | 52/107 |
| 2,086,247 | 7/1937 | Thesen | 52/107 |
| 2,604,268 | 7/1952 | Skagerberg | 237/1 |

FOREIGN PATENTS OR APPLICATIONS

| | | | |
|---|---|---|---|
| 124,804 | 10/1901 | Germany | 52/198 |
| 432,112 | 9/1901 | Switzerland | 52/169 |

*Primary Examiner*—James L. Ridgill, Jr.
*Attorney, Agent, or Firm*—William R. Woodward

[57] ABSTRACT

A living space with a floor below the natural ground level with a ceiling above the natural ground level is made more suitable for habitation without impairment of the qualities of space in upper stories and of surrounding grounds by providing slanting side walls for the upper part of the basement level, with windows therein. A reconstituted ground level is provided sloping up towards the basement ceiling, interrupted with graded basins in to which the basement windows respectively look.

8 Claims, 3 Drawing Figures

DWELLING HOUSE

The construction of a dwelling house on a plot of ground is the more satisfactory as the total living area is larger and occupation of ground is less whilst allowing for garden and play area. By imposing limitations of height of the structure in relation to its spacing which separate it from the limit of a neighbouring plot, legalisation makes impossible in practice the construction of buildings with large living area and small ground area on restricted plots of land limited by neighbouring plots.

In the article entitled "Walled garden houses and taller terraces" in the number B of May 1966 of the review "Interbuild" pages 30 to 32, there is described a dwelling building of the semi-basement type comprising a storey of which the floor is below, and the ceiling is above reconstituted ground which surrounds the house. The projection of the upper storey is, at least at two sides, inset from the perimeter of the lower level. Contact of the side faces of the lower storey with one or more margins of a basin which surrounds the building, enhances sound and heat insulation. Construction is moreover facilitated by reason of the support thus afforded and cost is reduced. But this proposal does not allow for increasing the living area for an enclosure of ground subject to legal restrictions, since the floor of the lower storey is at the level of original unreconstituted earth. Moreover, the lower storey can only be used for cellars or garages and not for habitation, because of inadequate light.

According to the invention in order to provide for such light the upper part of one or preferably more of the side faces of the lower storey is spaced from the lateral walls of a hollow excavation in the ground (and optionally from the lateral walls of a reconstituted ground) immediately surrounding the house and includes a window. External view and light are excellent when the said upper part slopes upwards and inwards, a basin with an axis perpendicular to the slope being advantageously provided in ground reconstituted as garden on the natural or undisturbed ground.

In such a house the ground opposed to the upper part is sloped back from said sloping upper part. It is better in regard to light, that the projection on a horizontal plane of an upper storey particularly superimposed on the lower storey which has sloping windows, be included at least as to the side face comprising the window within the perimeter of the lower storey. It is recommended that such side face of the lower storey is extended forwards relatively to the corresponding side face of the upper storey.

In the annexed drawings which are only by way of example:

Figure 1:
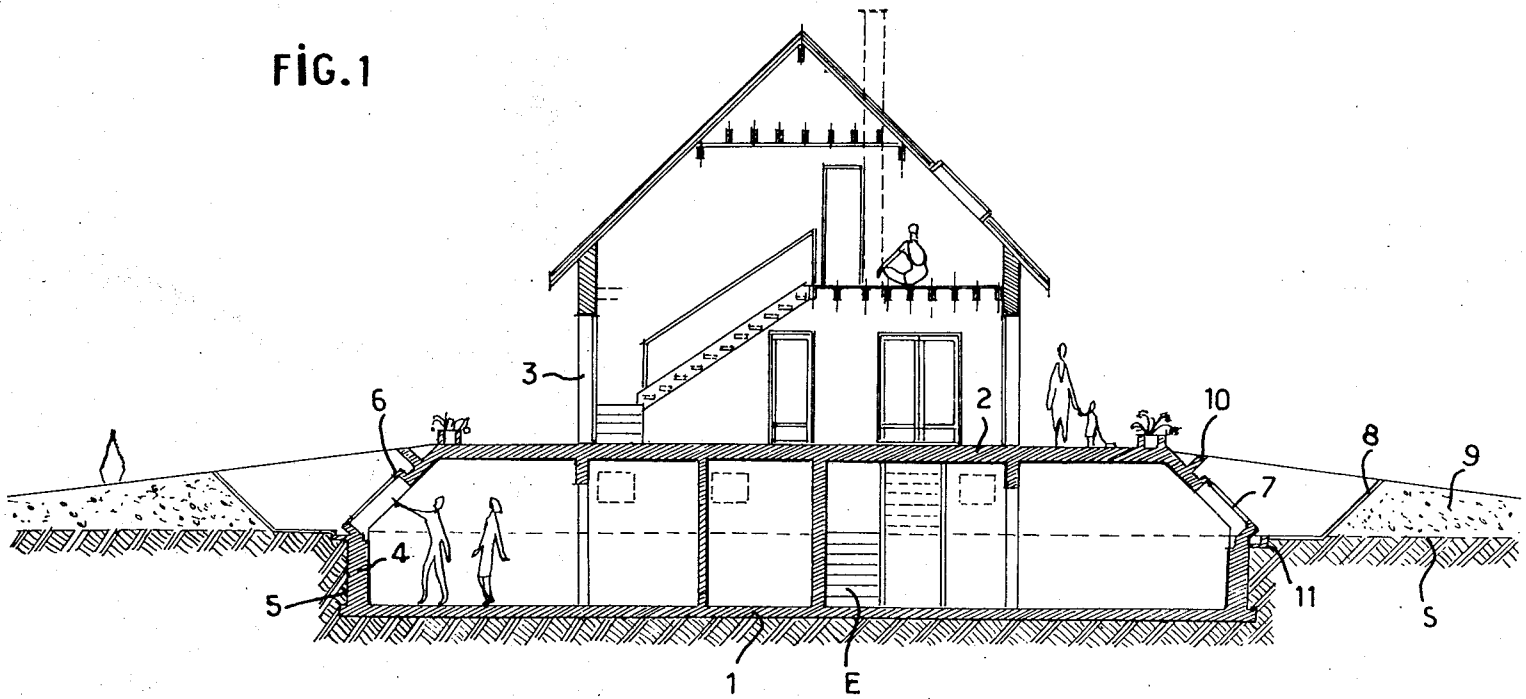
FIG. 1 is a schematic section of a dwelling house according to the invention.

The house of FIG. 1 comprises a lower storey communicating with two upper storeys by stairway E. The lower level or floor 1 of the lower storey or the ceiling of the lower storey is below the natural ground level S. The lower level 2 of the first upper storey is above level S. The four side faces 3 of the upper storey delimit a perimeter of less area than that which is delimited by the four side faces 4 of the lower storey. The lower part of the faces 4 is in contact with the wall of an excavation 5 hollowed in the ground S.

The upper parts of the faces 4 are sloped at 6 and are above the level of the ground S. They comprise windows 7 giving on to basin formations 8 provided in reconstituted ground above the ground S. The axes of symmetry of the basin formations are perpendicular to the respective sloped faces 4. Two upper 10 and lower 11 gutters are provided above and below the upper and lower margins of the windows. The gutter 10 retains a portion of reconstituted earth 9 in addition to the withdrawal of water.

Figure 2:
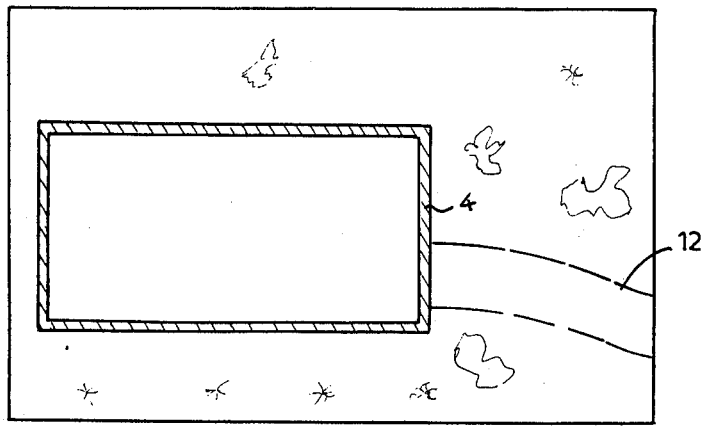
FIG. 2 is a view in horizontal section of the lower storey.

In FIG. 2 is provided a ramp 12 for direct access to the outside from the lower storey. This ramp occupies only a part of one of the faces 4.

Figure 3:
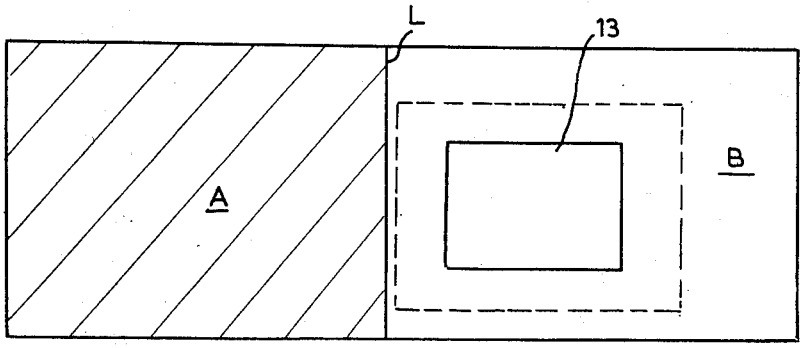
FIG. 3 is a plan view of two plots on one of which is a building according to the invention.

In FIG. 3, the regulations of party rights applicable to plot B by the reason of presence of plot A do not prevent occupiable parts reaching practically to the boundary L between the two plots. These delineated parts, are at the lower storey. The upper storey and the roof 13 are further to the interior of the plot. The habitable area is substantial, and light is good because the elements of the lower storey project from each side face of the upper storey.

Thus, the present invention discloses a dwelling house a storey of which comprises:

a horizontal floor which is below the level of the natural ground which immediately surrounds the house;

a horizontal ceiling which is above said ground level;

side faces, one of which has an upper part which is above the the ground level and which slopes upwards and inwards, and a window provided in said sloped upper part.

I claim:

1. A dwelling house, a storey of which comprises:

a horizontal floor which is below the level of the natural ground which immediately surrounds the house;

a horizontal ceiling which is above said ground level;

side faces extending from said floor to said ceiling and enclosing therewith at least one dwelling room, one of which side faces has an upper part which is above said ground level and which slopes upwards and inwards;

a window provided in said sloped upper part giving light to one said dwelling room and facing into a basin provided in the reconstituted ground above the natural ground, the bottom of the basin being approximately at the level of the natural ground.

2. House as claimed in claim 1, wherein the reconstituted ground across said basin from and opposite to said upper part is sloped back away from said sloping upper part.

3. House as claimed in claim 1, wherein an axis of the basin is perpendicular to the sloping upper part.

4. House as claimed in claim 1, wherein a gutter is provided in the basin above the window.

5. House as claimed in claim 1, wherein a gutter is provided in the basin below the window.

6. A dwelling house, a storey of which comprises:

a horizontal floor which is below the level of the natural ground which immediately surrounds the house;

a horizontal ceiling which is above said ground level;

side faces extending from said floor to said ceiling and enclosing therewith at least one dwelling room, one of which side faces has an upper part which is above said ground level and which slopes upwards and inwards, and a window provided in said sloped upper part giving light to one said dwelling room.

7. House as claimed in claim 6 comprising aother superimposed storey, at least one side of the horizontal plan projection of said other storey being within the perimeter of the storey referred to in claim 6.

8. House as claimed in claim 6, wherein the bottom of the side faces is in contact with the walls of an excavation in said natural ground.

* * * * *